US005294788A

United States Patent [19]

Charon et al.

[11] Patent Number: 5,294,788

[45] Date of Patent: Mar. 15, 1994

[54] LOW LIGHT LEVEL, HIGH RESOLUTION IMAGER USING PHOSPHOR SCREEN PROVIDED WITH A METAL LAYER FOR CONTROLLING INTEGRATION CYCLE OF PHOTOSENSITIVE MATRIX ARRAY

[75] Inventors: Yves Charon, Gif; Jean-Marc Gaillard, Gex; Michel Leblanc, Antony; Roland Mastrippolito, Plaisir; Hervé Tricoire, Palaiseau; Luc Valentin, Bures; Philippe Laniece, Paris, all of France

[73] Assignee: Centre National de la Recherche Scientifique (CNRS), France

[21] Appl. No.: 975,930

[22] PCT Filed: Aug. 21, 1991

[86] PCT No.: PCT/FR91/00680

§ 371 Date: Apr. 16, 1993

§ 102(e) Date: Apr. 16, 1993

[87] PCT Pub. No.: WO92/03836

PCT Pub. Date: Mar. 5, 1992

[30] Foreign Application Priority Data

Aug. 23, 1990 [FR] France ..... 90 10593

[51] Int. Cl.[5] ..... H01J 31/50

[52] U.S. Cl. ..... 250/214 VT; 250/483.1

[58] Field of Search ..... 250/214 VT, 483.1; 313/525, 527

[56] References Cited

U.S. PATENT DOCUMENTS 3,742,224 6/1973 Einstein ..... 250/214 VT
3,777,201 12/1973 Einstein ..... 250/214 VT
4,893,020 1/1990 Ono ..... 250/483.1
4,900,930 2/1990 Takiguchi et al. ..... 250/472.1
5,235,191 10/1993 Miller ..... 250/483.1

OTHER PUBLICATIONS

"High Spectral Resolution, Photon Counting Detector for Doppler Temperature Measurements in Magnetically Confined Plasmas"; R. D. Benjamin et al.; Review of Scientific Instruments; 58(v) Apr. 1987; pp. 520–529.

"A High Resolution Beta-Imager for Biological Applications"; Y. Charon et al.; Institute de Physique Nucléaire; Sep. 1989.

*Primary Examiner*—David C. Nelms
*Assistant Examiner*—Stephone B. Allen
*Attorney, Agent, or Firm*—Blakely, Sokoloff, Taylor & Zafman

[57] ABSTRACT

The present invention relates to a low level, high resolution imager of the type comprising a light-amplifier tube (300) including a photocathode (310), at least one microchannel slab (330) serving as an electron amplifier, and a light-emitting phosphor screen (340) provided with a metal layer (342), an electron camera (400) comprising a photosensitive matrix array (410) suitable for transforming a received photon into an electron, and control means (700) for the electron camera, characterized by the fact that the control means (700) comprise an amplifier (710) responsive to the electrons collected on the metal layer (342) of the light-emitting phosphor screen (340) to control integration cycles of the photosensitive matrix array (410) in repetitive one-shot mode synchronized on the appearance of photons at the input of the light-amplifying tube (300).

12 Claims, 3 Drawing Sheets

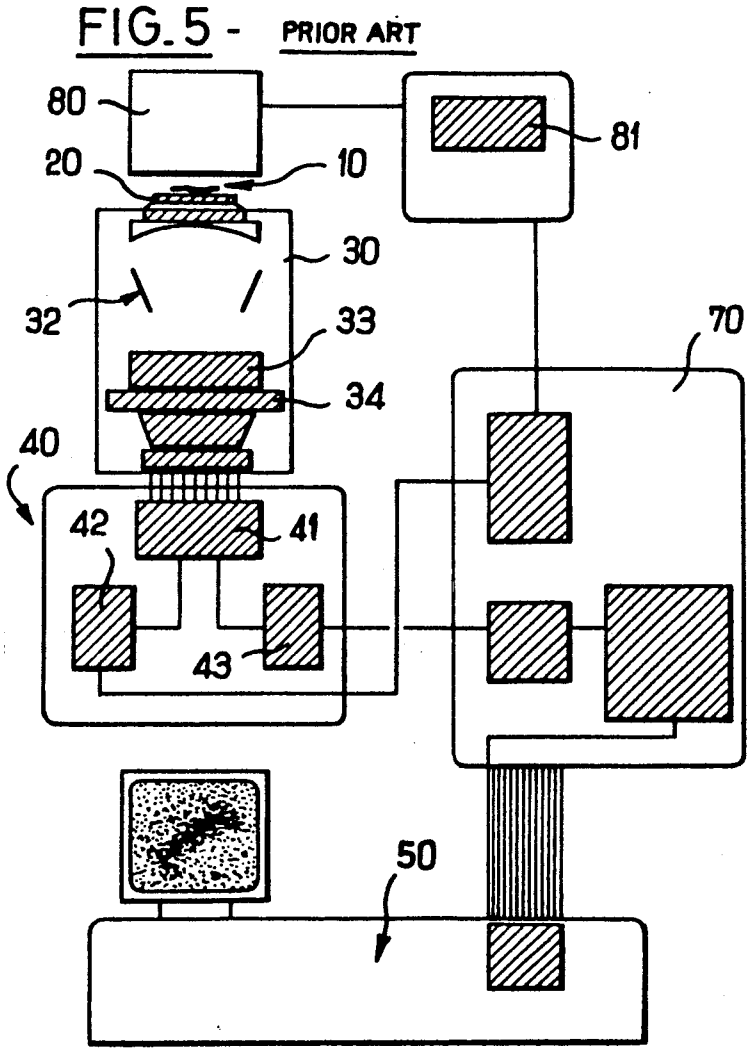
FIG. 5 - PRIOR ART
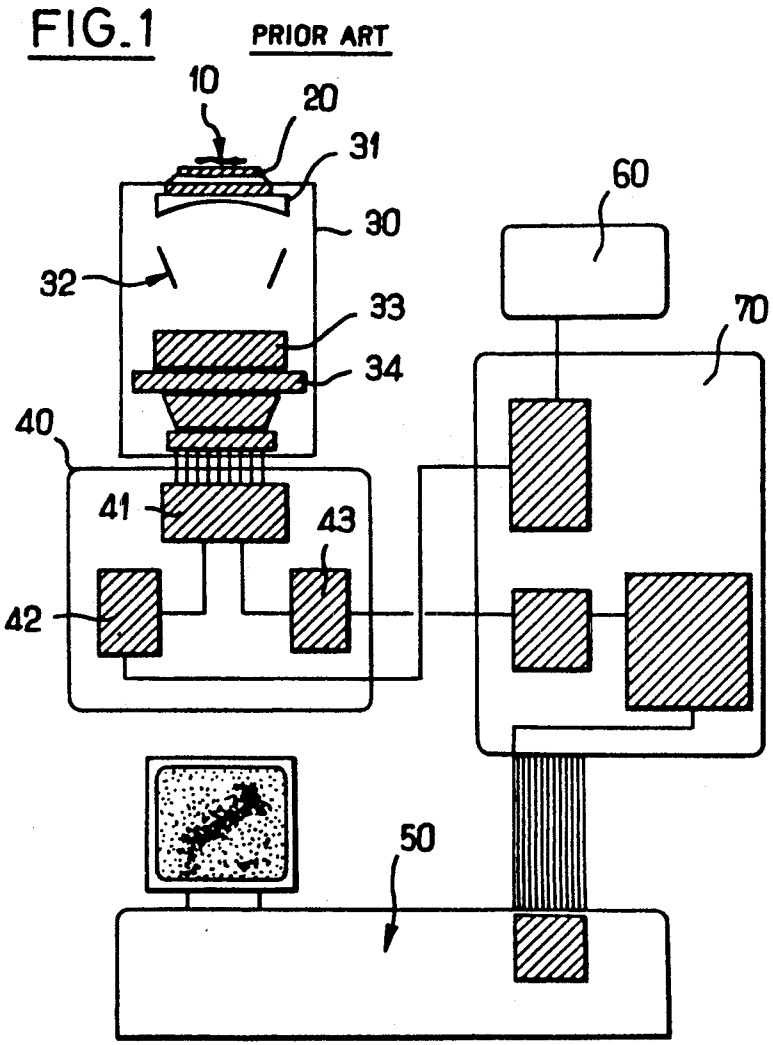
FIG. 1 PRIOR ART 200
310
330
331
300
342
340
341
700
710
714
R 712
400
410
420
430
720
500

LOW LIGHT LEVEL, HIGH RESOLUTION IMAGER USING PHOSPHOR SCREEN PROVIDED WITH A METAL LAYER FOR CONTROLLING INTEGRATION CYCLE OF PHOTOSENSITIVE MATRIX ARRAY

The invention relates to a low light level, high resolution imager.

A large amount of work in physics (nuclear physics, astrophysics, biophysics) requires it to be possible to locate with great accuracy light sources that are of very low level in terms of photon count.

For example, much work performed in molecular biology derives its information by studying the three-dimensional positioning of chemical species (strands of DNA or of RNA). To do this, the commonly-used technique consists in marking the species being studied with a specific radioactive probe. An experimental result is thus expressed in the form of a map of $\beta$-emitting populations, the map being optionally quantitative and of greater or lesser resolution.

For several years, proposals have been made to pick up an image of light sources using charge coupled devices (CCD).

For example, in the article by Y. Charon et al. entitled "A high resolution $\beta$-detector" published in the document Nuclear Instruments and Methods in Physics Research, A 273 (1988), 748–753, a system is described as shown diagrammatically in accompanying FIG. 1, which system is particularly adapted to experiments in molecular biology, and comprises:

- a sample carrier 10;
- a thin scintillator 20 (10 $\mu$);
  - a light-amplifying tube 30 essentially comprising:
  - a photocathode 31;
  - focusing electrodes 32;
  - a slab 33 of microchannels that amplify electrons by secondary emission; and
  - a light emitting phosphor screen 34; an electron camera 40 comprising:
  - a charge coupled device (CCD) 41;
  - a control module 42; and
  - a shaping module 43;
- a governing computer 50;
- an external trigger generator 60; and
- an interface card 70 between the generator 60, the camera 40, and the computer 50.

The scintillator 20 generates photons when it detects an electron coming from the sample or from an equivalent source. The light is amplified in the tube 30 and is then applied to the electron camera.

The module 42 controls this camera in one-shot mode, not in video mode. In video control mode, frame-cycles follow one another at a fixed rate (where each cycle is made up of a stage during which the charge coupled device is reset to zero, followed by an image integration stage, and then by a read stage). In contrast, in one-shot control mode, each frame-cycle is controlled independently of the preceding cycle.

More precisely, according to the above-mentioned document, the camera 40 is controlled in repetitive one-shot mode by the external trigger generator 60, i.e. the camera 40 is controlled to have short and repetitive integration cycles as opposed to a simple one-shot mode which would consist in integrating the image of the light source over a long period and then in reading it solely at the end of acquisition.

The control of the camera 40 is shown diagrammatically in accompanying FIGS. 2, 3, and 4.

Figure 4:
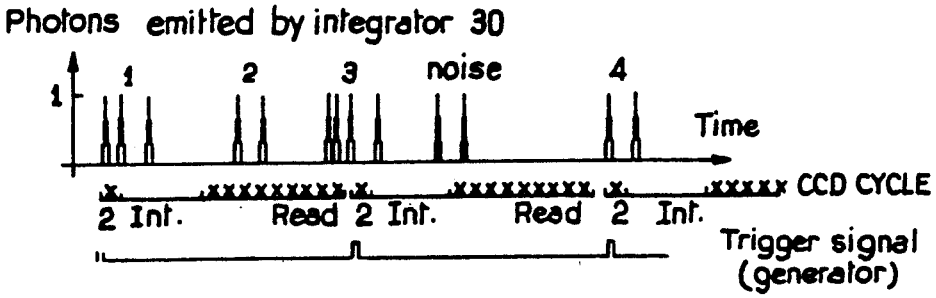

Finally, FIG. 4 shows the response of the tube 30 superposed firstly on the cycles of the charge coupled device 41, each of which includes a stage during which the CCD is reset to zero, an image integration stage, and a CCD reading stage, and secondly the signal which triggers the cycles.

The technique of controlling the camera 30 in repetitive one-shot mode makes it possible to escape in part from the major cooling required in repetitive one-shot mode because of the contribution of thermal noise in the light-amplifying tube and in the camera, which noise is proportional to the integration time.

However, controlling the camera 30 in competitive one-shot mode does not give complete satisfaction. It suffers from the following drawbacks:

events are lost during dead time, thereby loosing efficiency;

given the integration time, the contribution of thermal noise from the amplifier tube remains large; and pixel brightness information cannot be used quantitatively since events occur randomly within the integration window.

Attempts have been made to eliminate these drawbacks by triggering the integration cycle of the charge coupled device only in the presence of a light event.

The system proposed to do this is described in the article by Y. Charon e1. entitled "H.R.R.I., a high resolution $\beta$- imager for biological applications", published in Nuclear Instruments and Methods in Physics Research A 292 (1990), 179–186. That system is also shown diagrammatically in accompanying FIG. 5.

There can be seen again in FIG. 5:

- the sample carrier 10;
- the scintillator 20;
- the light-amplifying tube 30;
- the electron camera 40;
- the governing computer 50; and
- the interface card 70.

However, in the system shown in FIG. 5, the external trigger generator 60 is replaced by a photomultiplier 80 which is associated with a shaping card 81.

Relative to the sample carrier 10, the photomultiplier 80 is disposed on the opposite side to the scintillator 20. Thus, the photomultiplier picks up a fraction of the photons generated by the scintillator 20 after they have passed through the sample and the sample carrier 10, for the purpose of generating a trigger pulse that is synchronized on the appearance of a light event.

The integration time may be adjusted to a minimum value that is a function solely of the phosphor decay time of the light-amplifier tube 30 and of the time required by the reset to zero stage of the charge coupled device 41.

Figure 6:
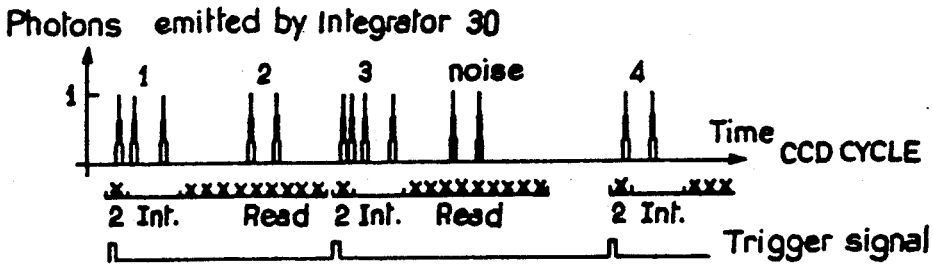

The cycles obtained in this way, and the corresponding trigger signals are shown diagrammatically in accompanying FIG. 6.

A comparison of FIGS. 4 and 6 shows that the system in which triggering is synchronized on the appearance of a light event, as shown in FIG. 5, provides the following advantages:

considerably increased detection efficiency;

a great reduction in the contribution of thermal noise since the integration time is reduced, while the noise occurs randomly within the integration window; and brightness intensity is accurately reproduced, thus making it possible to perform screening and center-of-gravity processing.

Nevertheless, the system shown in FIG. 5 does not give full satisfaction either.

That system is firstly dependent on the thickness of the sample used. If the sample is too thick, the photomultiplier 80 receives little or no light.

Further, that system is essentially limited to the field of experimentation in molecular biology, and it is not suitable, for example, for use in astrophysics.

An object of the present invention is to improve the situation by eliminating the drawbacks of the prior art.

According to the present invention, that object is achieved by a low light level, high resolution imager of the type comprising:

a light-amplifying tube comprising:

a photocathode;

at least one microchannel slab serving as an electron amplifier; and a light emitting phosphor screen provided with a metal layer:

an electron camera comprising a photosensitive matrix array suitable for transforming a received photon into an electron; and control means for controlling the electron camera;

the imager being characterized by the fact that the control means comprise an amplifier responsive to the electrons collected on the metal layer of the lightemitting phosphor screen to control integration cycles of the photosensitive matrix array in repetitive one-shot mode synchronized on the appearance of photons at the inlet to the light-amplifying tube.

Figure 2:
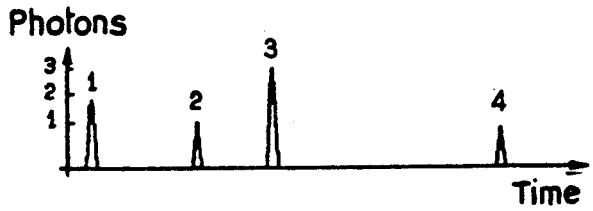
FIG. 2 shows the time distribution of a light source or sample.
Figure 3:
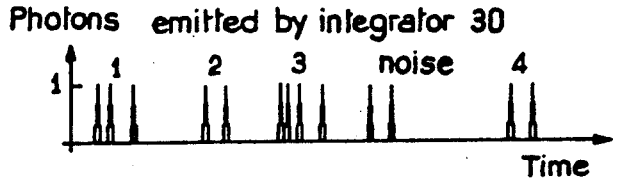
FIG. 3 shows the corresponding response of a light-amplifying tube 30. Noise pulses can be seen in FIG. 3.
Figure 7:
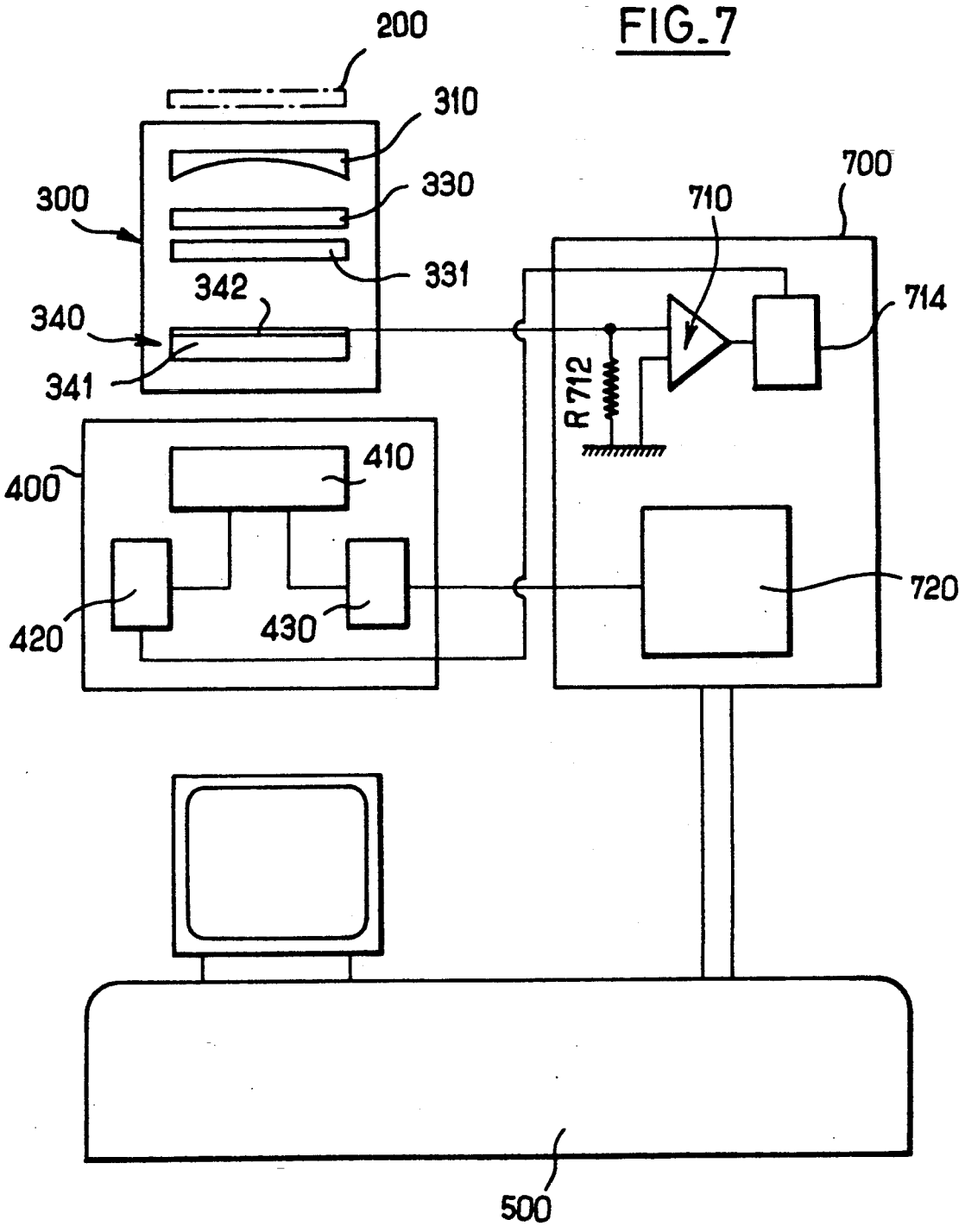

Other characteristics, objects, and advantages of the present invention appear on reading the following detailed description made with reference to the accompanying drawings which are given by way of nonlimiting example, and in which:

FIG. 1, described above, is a diagram of a first previously known system;

FIG. 2 shows the time distribution of a light source;

FIG. 3 shows the corresponding response as collected at the outlet of a light-amplifying tube;

FIG. 4 shows the cycles and the trigger signal of the system shown in FIG. 1;

FIG. 5, described above, is a diagram of a second previously known system;

FIG. 6 shows the cycles and the trigger signal of the system shown in FIG. 5; and FIG. 7 is a block diagram of an imager of the present invention.

The imager of the present invention shown in accompanying FIG. 7 comprises a light-amplifying tube 300, an electron camera 400, a control circuit 700, and a computer 500.

The light-amplifying tube 300 is preferably of the proximity focusing type fitted with two microchannel slabs giving it high gain.

As shown in accompanying FIG. 7, the tube 300 essentially comprises: a photocathode 310, two slabs 330 and 331 of microchannels that serve as electron amplifiers, and a phosphor screen 340 constituting an anode.

The phosphor screen 340 comprises, more precisely, a phosphor layer 341 covered on its side facing the slabs 330, 331 with a thin layer of metal 342, generally of aluminum.

Thus, the shower of secondary electrons corresponding to one photo-electron being amplified by the slabs 330 and 331 is accelerated towards the screen 340. When the electrons are slowed in said screen, light is produced by the excited medium 341 and the electrons are collected in a few ns on the metal-coated face 342 of the screen.

The electron/electron gain of a tube 300 having two slabs 330, 331 is typically of the order of 105

As mentioned above as constituting an essential characteristic of the present invention, the control circuit 700 comprises an amplifier 710 responsive to the electrons collected by the metal layer of the screen 340 for controlling the integration cycles of the camera 400 via a gate 714. The function of the gate 714 is to transform the analog signal from the amplifier 710 into a logic signal. The gate 714 operates essentially by integration and by comparison with a threshold. For example it may be constituted by the integrating linear gate sold by the firm SEPH. The gate 714 is placed between the output of the amplifier 710 and the input of the module 420.

More precisely, in a preferred embodiment shown in FIG. 7, the metal layer 342 of the screen is connected to ground via a resistor R712 and the metal layer 342 is connected to a first input of the operational amplifier 710, while the second input thereof is grounded.

Charge flowing through the resistor R712 thus serves to generate a potential difference at the input of the amplifier 710.

This voltage is amplified by the voltage amplifier 710. The amplifier is of the wide passband and low noise type. The signal is then charge integrated and is then subjected to a voltage threshold in the gate 714, such that when the gate is enabled, a trigger signal is applied to the module 420.

The electron camera 400 used in the context of the present invention advantageously comprises a charge coupled device (CCD) 410, a control module 420, and a module 430 for shaping the signals picked up by the CCD, in a manner similar to systems known in the past, and described above with reference to FIGS. 1 and 5.

The trigger signal from the gate 714 is then applied to the input of the control module 420 so that each trigger signal initiates a reset-to-zero or "cleaning" cycle of the CCD, integration of the image on the CCD, and then reading thereof via the module 430.

The signals obtained in this way then pass via an interface card 720 before being directed to the computer 500 where they are processed in a manner that is known per se, as described in the prior documents described above.

It may be observed that the phosphor screen 340 must have a period that is compatible with the time taken to reset the CCD 410 to zero. The screen is required to store the image during the reset-to-zero time of the CCD preceding each integration.

In order to obtain a reset-to-zero duration that is very short, e.g. about 1 μs, it is possible to use an anti-dazzle system of certain CCDs in accordance with the dispositions described in the document by R.E. Ansorge et al., entitled "The UA2 scintillating fiber detector", published in Nuclear Instruments and Methods A 273 (1988), 748–753. The integration time can then be reduced proportionally by using a screen having a semi-fast phosphor (a few μs). This type of operation makes the contribution of the detector's thermal background noise negligible.

The imager of the present invention makes it possible to provide an image of a very low level light source (single photo-electron sensitivity) with a resolution of the order of 20 μm.

It is recalled that a charge coupled device (CCD) is a matrix array of about $10^4$ photocells of small size (about 20 μm by 20 μm), each suitable for transforming a received photon into an electron. During the integration stage, each cell accumulates a quantity of charge proportional to the light it receives. Reading consists in sequentially transferring the contents of each cell to an imaging device (in this case preferably the computer 500 via the interface card 720).

Where applicable, in the context of the present invention, the charge transfer device 410 may be replaced by a CID type device known to the person skilled in the art and in which the charge accumulated in each cell is read directly without transfer.

The inventors have performed tests using an imager comprising a light-amplifier tube 300 with proximity focusing and fitted with two microchannel slabs 330 and 331 to obtain an electron/electron gain of the order of $10^5$, together with a fast phosphor screen (P47), a CCD electron camera 400, a low noise (<5 mV) and wide passband (about 200 MHz) voltage amplifier 710 having a voltage gain of 100, and an integrating linear gate 714 as sold by the firm SEPH.

Those tests have shown a triggering efficiency of 90% on incident light events of minimum amplitude, i.e. corresponding to single photoelectrons. Said efficiency is given by the ratio of the number of single photoelectrons emitted by the photocathode of the tube 300 and the number thereof actually detected by the imaging system.

The above described imager is designed to detect incident light photons.

Nevertheless, the imager could easily be adapted to detect other types of incident ray, for example β- rays, merely by placing a system for converting said incident rays into light, e.g. a scintillator 200, upstream from the tube 300, and as shown in chain-dotted lines in FIG. 7.

Naturally, the present invention is not limited to the embodiments described above, but extends to any variant coming within the spirit thereof.

Where appropriate, it is possible to consider using a tube having a single microchannel slab for example.

Likewise, it is possible to envisage using an electrostatically focused light-amplifying tube as shown diagrammatically in FIGS. 1 and 5.

What is claimed is:

1. A low light level, high resolution imager of the type comprising:

a light-amplifying tube (300) comprising:

a photocathode (310);

at least one microchannel slab (330, 331) serving as an electron amplifier; and a light emitting phosphor screen (340) provided with a metal layer (342);

an electron camera (400) comprising a photo-sensitive matrix array (410) suitable for transforming a received photon into an electron; and control means (700) for controlling the electron camera (400);

the imager being characterized by the fact that the control means (700) comprise an amplifier (710) responsive to the electrons collected on the metal layer (342) of the light-emitting phosphor screen (340) to control integration cycles of the photosensitive matrix array (410) in repetitive one-shot mode synchronized on the appearance of photons at the inlet to the light-amplifying tube (300).

2. An imager according to claim 1, characterized by the fact that the light-amplifying tube (300) includes two microchannel slabs (330, 331).

3. An imager according to claim 1 or 2, characterized by the fact that the electron/electron gain of the light-amplifying tube (300) is of the order of 105.

4. An imager according to any one of claims 1 to 3, characterized by the fact that the photosensitive matrix array (410) of the electron camera (400) is a charge coupled device.

5. An imager according to any one of claims 1 to 4, characterized by the fact that the metal layer (342) of the phosphor screen (340) is grounded via a resistor (R712) and is also connected to the input of the control amplifier (710).

6. An imager according to any one of claims 1 to 5, characterized by the fact that a logic shaping gate (714) is interposed between the output of the control amplifier (710) and the electron camera (400).

7. An imager according to any one of claims 1 to 6, characterized by the fact that a system (200) suitable for transforming incident radiation into light is placed upstream from the light-amplifying tube (300).

8. An imager according to claim 7, characterized by the fact that a scintillator (200) is placed upstream from the light-amplifying tube (300).

9. An imager according to any one of claims 1 to 8, characterized by the fact that the light-amplifying tube (300) is a proximity focusing tube.

10. An imager according to any one of claims 1 to 8, characterized by the fact that the light-amplifying tube (300) is a tube with electrostatic focusing.

11. An imager according to any one of claims 1 to 10, characterized by the fact that the metal layer (342) of the light-amplifying tube (300) is based on aluminum.

12. An imager according to claim 1, characterized by the fact that the photosensitive matrix array (410) is of the CID type.

* * * * *

UNITED STATES PATENT AND TRADEMARK OFFICE

CERTIFICATE OF CORRECTION

PATENT NO. : 5,294,788

DATED : March 15, 1994

INVENTOR(S) : Charon et al.

It is certified that error appears in the above-indentified patent and that said Letters Patent is hereby corrected as shown below:

In column 1 at lines 40-41 delete

"a light emitting phsophor screen 34; an electron camera 40 comprising:"

insert

--a light emitting phsophor screen 34; an electron camera 40 comprising:--

In column 2 at line 33 delete "Y. Charon el."

insert

--Y. Charon et al.--

UNITED STATES PATENT AND TRADEMARK OFFICE

CERTIFICATE OF CORRECTION

PATENT NO. : 5,294,788

DATED : March 15, 1994

INVENTOR(S) : Charon et al.

It is certified that error appears in the above-indentified patent and that said Letters Patent is hereby corrected as shown below:

In claim 3 in column 6 at line 24 delete "on the order of 105." insert

--on the order of $10^5$.--

Signed and Sealed this

Fifth Day of September, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,294,788

DATED : March 15, 1994

INVENTOR(S) : Charon et al.

It is certified that error appears in the above-identified patent and that said Letters Patent is hereby corrected as shown below:

In column 1 at line 40, please delete " phsophor " and insert -- phosphor --.

Signed and Sealed this

Twelfth Day of August, 1997

Bruce Lehman

*Attest:*

BRUCE LEHMAN

*Attesting Officer*

*Commissioner of Patents and Trademarks*